United States Patent [19]

Schoeman

[11] 4,094,933

[45] June 13, 1978

[54] SUPPLYING FUEL TO INTERNAL COMBUSTION ENGINES

[76] Inventor: Marthinus Johannes Schoeman, 13-14th Avenue, Edenvale, Transvaal Province, South Africa

[21] Appl. No.: 717,929

[22] Filed: Aug. 26, 1976

[30] Foreign Application Priority Data

Sep. 23, 1975 South Africa ..... 75/6062

[51] Int. Cl.[2] ..... F02M 7/22

[52] U.S. Cl. ..... 261/50 A; 261/51; 261/67; 261/64 C; 251/209

[58] Field of Search ..... 261/50 A, 51, 67, 64 C; 251/209

[56] References Cited

U.S. PATENT DOCUMENTS

| | | | |
|---|---|---|---|
| 1,235,180 | 1/1917 | Barber et al. | 261/64 C |
| 1,286,856 | 12/1918 | Weiland | 261/44 A |
| 1,369,419 | 2/1921 | Gibford | 261/67 |
| 1,402,749 | 1/1922 | Du Pont | 261/50 A |
| 1,563,705 | 12/1925 | Hansen-Ellehammer | 261/51 |
| 1,773,289 | 8/1930 | Waite | 261/50 A |
| 1,828,902 | 10/1931 | Monosmith et al. | 261/50 A |
| 3,130,247 | 4/1964 | Little | 261/50 R |
| 3,309,069 | 3/1967 | Braun et al. | 261/50 A |
| 3,322,408 | 5/1967 | Stoltman | 261/50 A |
| 3,432,152 | 3/1969 | Sweeney | 261/50 A |

FOREIGN PATENT DOCUMENTS

| | | | |
|---|---|---|---|
| 495,393 | 4/1930 | Germany | 261/50 A |

*Primary Examiner*—Tim R. Miles

*Attorney, Agent, or Firm*—Stevens, Davis, Miller & Mosher

[57] ABSTRACT

A carburettor for an internal combustion engine, which includes a duct connectable to a combustible charge inlet of the engine; a butterfly valve pivotally mounted within the duct and connectable to a throttle linkage of the engine to permit control of airflow through the duct; and a housing provided exteriorly of the duct, the housing having an inlet adapted for connection to a fuel source, an outlet passage leading into the duct, and at least one valve means intermediate the inlet connection and the outlet passage for regulating fuel flow into the duct.

13 Claims, 6 Drawing Figures

SUPPLYING FUEL TO INTERNAL COMBUSTION ENGINES

This invention relates to supplying fuel to internal combustion engines.

Many prior carburettors of which the applicant is aware suffer from the disadvantage that they are complex and costly to produce and do not permit of ready adjustment. Passages and channels for feeding fuel through the various stages of the prior carburettors necessitate costly machining and casting operations during manufacture. Prior carburettors also sometimes have different mechanisms which become operative during various stages. A wide variety of carburettors also have to be produced to cater for various engines. It is an object of this invention to provide a carburettor which, it is believed, will avoid these disadvantages.

According to the invention there is provided a carburettor for an internal combustion engine, which includes a duct connectable to a combustible charge inlet of the engine; a butterfly valve pivotally mounted within the duct and connectable to a throttle linkage of the engine to permit control of airflow through the duct; and a housing provided exteriorly of the duct, the housing having an inlet adapted for connection to a fuel source, an outlet passage leading into the duct, and at least one valve means intermediate the inlet connection and the outlet passage for regulating fuel flow into the duct.

The housing may be removably mounted on the exterior of the duct, the outlet passage being in the form of a pipe leading to a position within the duct. This permits various constructions of valve means and ducts to be readily assembled to cater for various forms of engines.

The valve means may include a control valve and a regulating valve connected in series intermediate the inlet connection and the outlet passage. The control valve and regulating valve may be independently operable.

The carburettor may further include a fuel control vane pivotally mounted within the duct upstream of the butterfly valve and biassed by biassing means to operate in conjunction with airflow through the duct, the fuel control vane being linked by a link to the regulating valve to control fuel flow through the regulating valve dependent upon the rate of airflow through the duct as determined by the fuel control vane.

The carburettor may still further include a vacuum inducing vane pivotally mounted within the duct upstream of the butterfly valve and biassed by biassing means to impede airflow through the duct.

The vacuum inducing vane may then be linked by a link to the control valve thereby to control fuel flow through the control valve dependent upon the pivotal movement of the vacuum inducing vane caused by airflow through the duct. In another embodiment, the control valve may be linked to the butterfly valve to operate in unison with the butterfly valve.

The or each link may be adjustable to permit adjustment of the relationship between movement of the or each vane and operation of the or each valve.

In another embodiment the or each link may include a cam and cam follower respectively attached to the vane and valve. The cam may then have an irregular profile thereby to provide a non-linear relationship between movement of the or each vane and operation of the or each valve.

The duct may comprise a plurality of barrel-like sections mountable one on the other. The first section may have the vacuum inducing vane therein, the second section may have the fuel control vane therein and the housing mounted on its outside, and the third section may have the butterfly valve therein. The third section may have a flange at its lower end to permit connection to the inlet manifold of the engine, and the first section may have a collar at its upper end to permit connection of an air cleaner thereto. The housing could however be mounted remote from the duct if desired.

The barrel-like sections may have dissimilar internal cross-sections. Preferably, the second central section has a smaller diameter than the other two sections to create a venturi effect within the duct.

The fuel control vane and vacuum inducing vane may be pivotally mounted offset from the axis of the duct. They may also be pivotable in opposite directions relative to each other.

In addition to being controllable in response to movement of the fuel control vane, the regulating valve may also be displaceable, e.g. manually via a cable or automatically by a temperature responsive device, towards its open position. This permits extra fuel to be supplied into the duct while the engine is being started or when extra fuel is needed under load or power conditions. The carburettor can thus be operated in an economy mode or in a power mode.

The bias applied to the vanes may be adjustable. The inoperative positions of the vanes may be determined by adjustable stop formations. The stop formation for the fuel control vane is conveniently set so that the regulating valve is closed completely when the engine is at a standstill.

The outlet from the outlet passage of the housing may be located, in operation, within a concentrated airstream resulting from airflow deflected by the vacuum inducing vane.

The valve means may include a regulating member in sealing engagement with the inner walls of the housing, the regulating member having a groove formed in its periphery to form a restricted passage between an inlet to and an outlet from the valve, and the regulating member being controllably displaceable to vary the supply of fuel from the inlet through the restricted passage to the outlet.

The groove in the regulating member may extend helically around the regulating member so that, during rotation of the regulating member, the helical groove is brought progressively into full alignment with the inlet or with the outlet. In another embodiment, the groove in the regulating member may be tapered and extend around the periphery of the regulating member in alignment with the inlet or with the outlet, the regulating member being rotatably displaceable to permit variation of the volume of fuel capable of being supplied through the groove.

The regulating member may also be axially displaceable relative to the inlet or to the outlet to permit adjustment of the initial alignment of the groove with the inlet or with the outlet. The regulating member may also be axially displaceable in operation by means of a working fluid, to permit the groove to be brought into slight misalignment with the inlet or with the outlet. The working fluid may be obtained by means of a negative pressure obtained from within the duct when the engine is running against compression to economise on the amount of fuel passed into the engine.

The control and regulating valves may extend inwardly from the respective sides of the housing. Communication between the valves may be by way of a transverse passage in the housing.

When the carburettor is used for supplying a plurality of fuels or a mixture of a fuel and an additive to the engine, it may include a plurality of control valves arranged in parallel each having a regulatable restricted passage. The further control valve may then also be in communication with the passage in the housing. The or each further control valve may be operable in conjunction with the butterfly valve in the duct, if required via an adjustable linkage. The taper or the cross-section of the respective grooves forming the restricted passages may be different to permit proportioning of different types of fuel fed into the respective inlets. If desired or necessary, when, say, oil is used, it may be supplied under pressure to the one inlet.

When the fuel used is a gas, gas under a predetermined pressure may be supplied to the inlet connection of the housing. When the fuel used is petrol, petrol may be fed under gravity or under a predetermined pressure into the inlet connection of the housing.

Various embodiments of the invention will now be described by way of example with reference to the accompanying drawings, in which.

Figure 1:
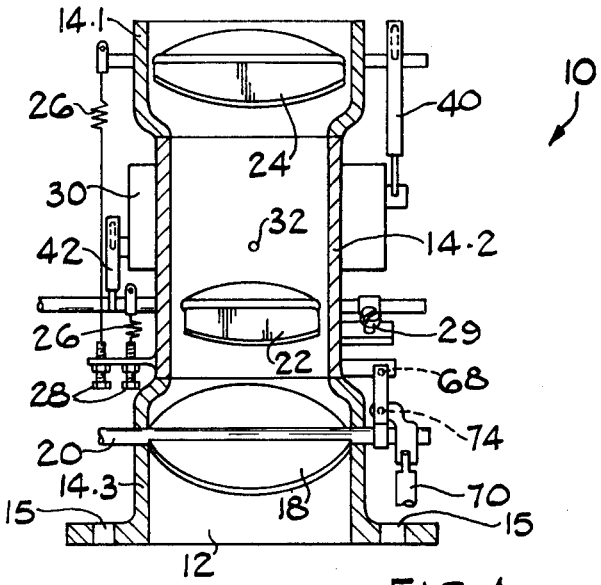
FIG. 1 shows an axial section through one embodiment of a carburettor in accordance with the invention.
Figure 2:
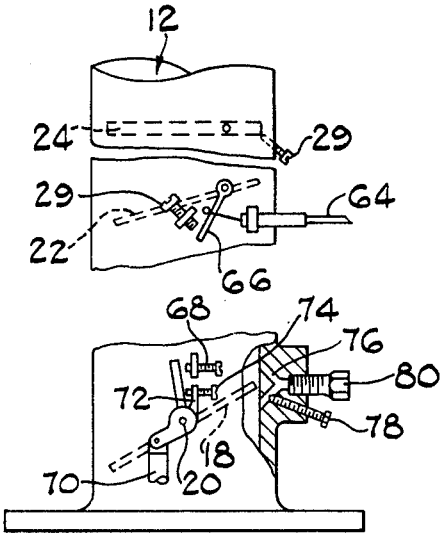
FIG. 2 shows a side elevation of portion of the carburettor shown in FIG. 1.
Figure 4:
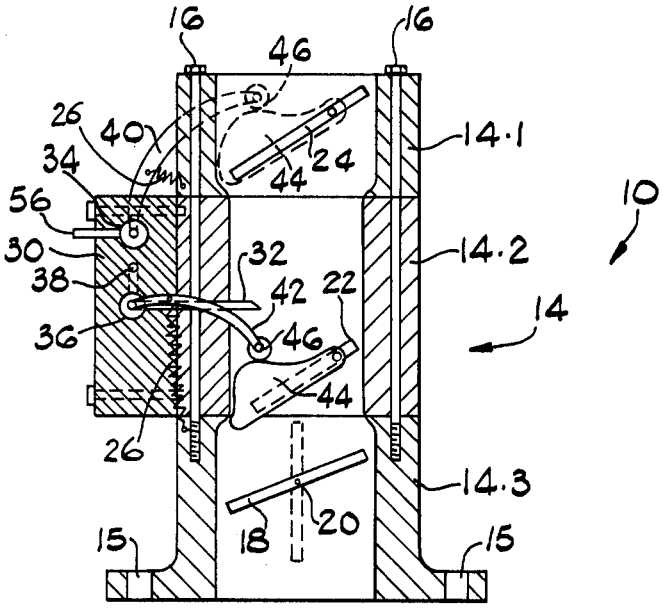
FIG. 4 shows a section at right angles to the section shown in FIG. 1 of a modified form of carburettor.

Referring to FIGS. 1, 2 and 4, reference numeral 10 generally indicates a carburettor for an internal combustion engine having a duct 12 defined by a barrel 14. The barrel 14 comprises three sections 14.1, 14.2 and 14.3 which are removably connected by bolts 16 as shown in FIG. 4.

In the lower section 14.3, a butterfly valve 18 is mounted on a spindle 20. The spindle 20 is connected to the normal throttle linkage of the engine.

A fuel control vane 22 and a vacuum inducing vane 24 are pivotally mounted on offset spindles in the middle and upper sections of the barrel 14 to be displaceable by airflow through the duct 12. As shown in FIG. 1, the vanes 22 and 24 are biassed to the closed position by springs 26, the tensions of which are adjustable by screws 28. The inoperative positions of the vanes 22 and 24 are determined by screws 29 (FIG. 2).

The central section 14.2 has a smaller diameter than the sections 14.1 and 14.3, to create a venturi action in the central section. The central section preferably has its opposed walls extending parallel but, if required, the wall may converge inwardly and then diverge. The barrel 14 is connectable to the combustible charge inlet of the engine, eg to the inlet manifold, via bolts or studs passing through apertures 15 in a flange at the lower end of the third section 14.3. A suitable collar (not shown) is conveniently provided on the first section 14.1 to permit an air cleaner to be fitted thereto.

A housing 30 is removably attached to the central section 14.2 of the barrel. If required, a gasket of heat insulating material may be provided intermediate the housing 30 and the barrel. The housing 30 controls the supply of fuel from a fuel source (not shown) into the duct 12 via a pipe 32.

Figure 3:
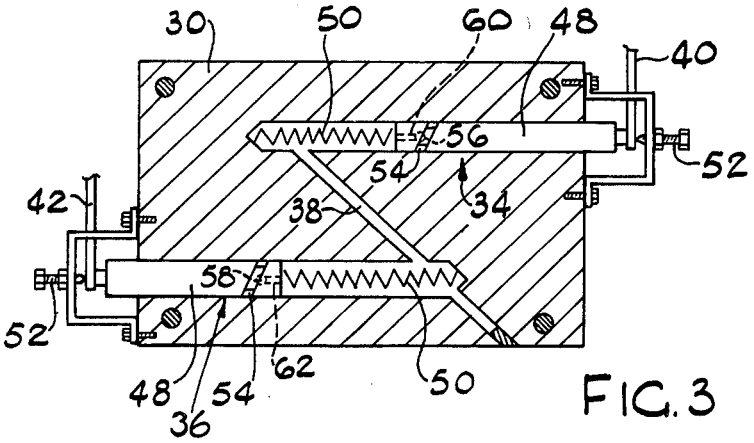
FIG. 3 shows a cross-section through the housing used in the carburettor.

The housing 30 is shown more clearly in FIG. 3 and includes a control valve 34 connected in series with a regulating valve 36 via a passage 38. The control valve 34 may be operable in conjunction with the butterfly valve 18 or, as shown in FIGS. 1 and 4, in conjunction with the vacuum inducing vane 24, via a link 40. The regulating valve 36 is connected via a link 42 to the fuel control vane 22 to operate in unison therewith. In the FIG. 1 embodiment, the links 40 and 42 are each connected to the vanes 22 and 24 and valves 34 and 36 via a pair of arms which engage ball and socket fashion with the links. The arms may be adjustable in length to permit adjustment of the stroke of the linkage. The links 40 and 42 may also be adjustably elongatable.

In a further arrangement shown in FIG. 4, the vanes 22 and 24 have cams 44 mounted exteriorly of the duct 12 and the links 40 and 42 have rollers 46 which ride on the cams 44. The cams 44 conveniently have an irregular profile so that there is a non-linear inter-relationship between movement of the vanes 22 and 24 and the operation of the control and regulating valves 34 and 36.

Reverting to FIG. 3, the control and regulating valves each comprise a regulating member 48 sealingly and rotatably mounted within a bore in the housing 30. Each regulating member 48 is biassed outwardly against an adjustable stop formation 52 by a spring 50. The regulating members 48 each have a helical groove 54 which, upon rotation of the regulating members 48, is brought progressively into full alignment with an inlet port 56 and an outlet port 58. Fuel under pressure is fed into the inlet port 56 into the helical groove 54 of the control valve 34. It then flows through an axial passage 60 in the regulating member 48 of the control valve 34 and into the passage 38. Thereafter it flows through a further axial passage 62 in the regulating valve 36, and out of the helical groove 54 to the outlet port 58. The outlet port 58 is in communication with the pipe 32 while the inlet port 56 is connectable to a fuel source.

Figure 6:
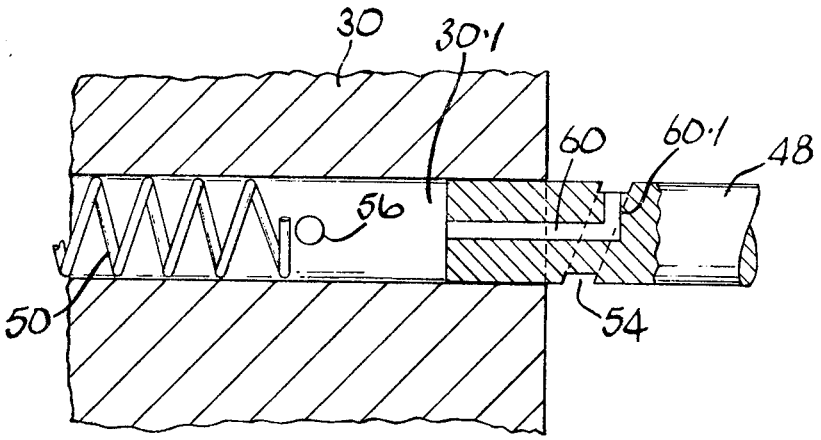
FIG. 6 shows details to a larger scale of a portion of the housing of FIG. 3.

The arrangement of the regulating members 48 in the housing 30 is shown more clearly in FIG. 6 which shows the one regulating member 48 partially inserted in one of the bores 30.1 in the housing 30. It will be appreciated that when assembled, the helical groove 54 will be located in proximity to the inlet port 56 as determined by the formation 52 and the degree of rotation of the regulating member 48. The axial passage 60 terminates in a transverse passage 60.1 thereby placing the helical groove 54 in communication with the bore 30.1. The construction of the regulating member 48 of the valve 36 is identical.

If required, a sleeve may be provided intermediate the regulating member 48 and the bore in the housing 30. The sleeve can then be finely machined to provide a good seal between it and the regulating member 48.

When it is desired to supply a plurality of fuels or a fuel and an additive into the engine, an additional control valve or valves 34 can be mounted in the housing 30. The additional control valve or valves can then be in communication with the passage 38.

Referring now to FIG. 2, it can be seen that the fuel control vane 22 in addition to being displaceable by airflow through the duct 12, is also manually displaceable by a cable 64 which operates within the elongated hole in an arm 66 fixed to the spindle on which the fuel control vane 22 is mounted. The arm 66 is such that the cable 64 does not impede pivotal movement of the vane 22 caused by airflow through the duct 12.

Also as shown in FIG. 2, the inoperative position of the butterfly valve 18 is determined by an adjustable screw 68 to determine the idling speed of the engine. In order to provide a fast idling speed when the engine is cold, a link 70 operates an arm 72 having an adjusting screw 74 to determine the fast idling speed. The link 70 is connected to a conventional temperature responsive device (not shown) which is usually mounted in proximity to or within the exhaust manifold of the engine.

Figure 5:
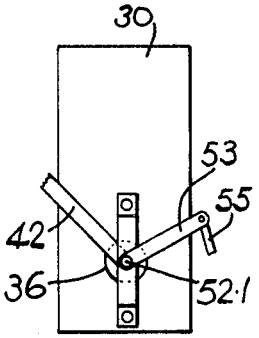
FIG. 5 shows a side elevation of portion of a modified form of carburettor.

The regulating valve 36 may also be linked to a temperature responsive device to provide a richer mixture when the engine is cold. The temperature responsive device may be arranged to rotate the screw 52 inwardly when the engine is cold to displace the helical groove 54 into fuller alignment with the port 54. This may be arranged via a rack and pinion arrangement. The rack and pinion arrangement may also be manually operable in certain applications, e.g. when the carburettor is used for aircraft engines, to permit a richer mixture to be supplied when required. This is shown in the FIG. 5 embodiment where a screw threaded member 52.1 is attached to a lever 53 and an operating arm 55 which can be connected to either a temperature responsive device or a manual control. This allows a richer mixture to be supplied when the engine is cold or when required by an operator.

When the butterfly valve 18 is in its idling position, i.e. as illustrated in FIG. 2, air is supplied via a by-pass passage 76 provided in the side wall of the barrel. The bypass passage 76 has an inlet and an outlet respectively above and below the position where the upper edge of the butterfly valve 18 is in proximity to the side wall of the barrel. Adjustment of the airflow through the by-pass passage 76 is provided by means of an adjusting screw 78 to provide a fine adjustment of airflow under idling conditions. A union 80 in communication with the passage 76 can be used to supply a partial vacuum to the automatic advance mechanism of the distributor of the engine. The partial vacuum may also be used to apply suction to the regulating members 48 to displace them outwardly when the engine is running against compression to reduce fuel flow through the grooves 54.

In use, a coarse regulation of the fuel supplied into the duct 12 is obtained by the operation of the control valve 34 in conjunction with the vacuum inducing vane 24 or with the butterfly valve 18. A finer regulation of the fuel is obtained by the operation of the regulating valve 36 which is operable in conjunction with the fuel control vane 22. In practice, the control valve 34 can be set to give a rich mixture at idling speeds and a leaner mixture as engine speed increases. The regulating valve 36 can then be set to give a lean mixture at idling speeds and give a progressively richer mixture as engine speed increases. The mixture can then be controlled readily at all speeds of the engine by varying the profiles of the cams 44. The regulating valve 36 prevents too much fuel being supplied to the engine at low speeds or during sharp acceleration. Only when there is sufficient airflow through the duct 12 as determined by the opening of the butterfly 18 to displace the vane 22, will more fuel be supplied into the duct. When the engine is at a standstill, the regulating valve 36 is closed completely to prevent fuel dripping into the duct 12. Under leavy load conditions, when extra power is required, or when starting the engine, the cable 64 can be operated to a required extent to open the fuel control vane 22 and thereby open the regulating valve 36 partially or fully, so that fuel can be regulated mainly by the control valve 34.

The invention provides a carburettor which can be used for various types of engines. Fine regulation of the fuel supplied to the engine at various speeds and under various load conditions can be achieved. The carburettor can be fitted in any configuration, i.e. updraft, side-draft or downdraft. In view of the housing 30 being mounted exteriorly of the barrel, the carburettor can be of simple construction as the fine machining in manufacture is confined mainly to the housing 30.

The carburettor can be assembled with various combinations of parts. Thus a larger barrel can be provided for larger engines or individual sections of the barrel can be replaced. Various forms of housing can be used in conjunction with various configurations of the barrel.

The carburettor can, it is believed, be manufactured at low cost because of the simplicity of its construction. A variety of fuels can also be used to operate an engine with a carburettor as shown. During all stages of operation of the carburettor, fuel is supplied from a single outlet, i.e. the outlet 32.

I claim:

1. A carburettor for an internal combustion engine, which includes a duct connectable to a combustible charge inlet of the engine; a butterfly valve pivotally mounted within the duct and connectable to a throttle linkage of the engine to permit control of airflow through the duct; a fuel control vane and a vacuum inducing vane pivotally mounted within the duct upstream of the butterfly valve and biassed by biassing means to operate in conjunction with airflow through the duct; and a housing provided exteriorly of the duct, the housing having an inlet adapted for connection to a fuel source, an outlet passage leading into the duct, and at least one valve means intermediate the inlet connection and the outlet passage for regulating fuel flow into the duct, the valve means including an independently operable control valve and a regulating valve which are connected in series intermediate the inlet connection and the outlet passage, the fuel control vane being linked by a link to the regulating valve to control fuel flow through the regulating valve dependent upon the rate of airflow through the duct as determined by the fuel control vane, and the vacuum inducing vane being linked by a link to the control valve thereby to control fuel flow through the control valve dependent upon the pivotal movement of the vacuum inducing vane caused by airflow through the duct.

2. A carburettor as claimed in claim 1, in which the housing is removably mounted on the exterior of the duct, the outlet passage being in the form of a pipe leading to a position within the duct.

3. A carburettor as claimed in claim 1, in which the regulating valve, in addition to being operable in conjunction with the fuel control vane, is also manually displaceable via manually operable connection means or via a temperature responsive device to a predetermined initial position.

4. A carburettor as claimed in claim 1, in which the duct comprises a plurality of barrel like sections mountable one on the other.

5. A carburettor as claimed in claim 4, in which the barrel-like sections have dissimilar internal cross-sections.

6. A carburettor as claimed in claim 1, in which the valve means includes a regulating member in sealing engagement with the inner walls of the housing, the regulating member having a groove formed in its periphery to form a restricted passage between an inlet to and an outlet from the valve, and the regulating member being controllably displaceable to vary the supply of fuel from the inlet through the restricted passage to the outlet.

7. A carburettor as claimed in claim 6, in which the groove in the regulating member extends helically around the regulating member and, during rotation of the regulating member, is brought progressively into full alignment with the inlet or with the outlet.

8. A carburettor as claimed in claim 6, in which the regulating member is axially displaceable within the housing relative to the inlet or to the outlet to permit adjustment of the initial alignment of the groove with the inlet or with the outlet.

9. A carburettor for an internal combustion engine, which includes a duct connectable to a combustible charge inlet of the engine; a butterfly valve pivotally mounted within the duct and connectable to a throttle linkage of the engine to permit control of air flow through the duct; a fuel control vane pivotally mounted within the duct upstream of the butterfly valve and biassed by biassing means to operate in conjunction with air flow through the duct; and a housing provided exteriorly of the duct, the housing having an inlet passage adapted for connection to a fuel source, an outlet passage leading into the duct and at least one valve means intermediate the inlet connection and the outlet passage for regulating fuel flow into the duct, the valve means including an independently operable control valve and a regulating valve which are connected in series intermediate the inlet connection and the outlet passage, each said control valve and regulating valve including a regulating member in sealing engagement with the inner walls of the housing, the regulating member having a groove formed in its periphery to form a restricted passage between an inlet to and an outlet from the valve, and the regulating member being controllably displaceable to vary the supply of fuel from the inlet through the restricted passage to the outlet, said groove in the regulating member extending helically around the regulating member and, during rotation of the regulating member, is brought progressively into full alignment with the inlet or with the outlet, the fuel control vane being linked by a link to the regulating valve to control fuel flow through the regulating valve dependent upon the rate of air flow through the duct as determined by the fuel control vane, and the butterfly valve being linked by a link to the control valve thereby to control the fuel flow through the control valve dependent upon the pivotal displacement of the butterfly valve.

10. A carburettor as claimed in claim 9, which further includes a vacuum inducing vane pivotally mounted within the duct upstream of the butterfly valve and biassed by biassing means to impede airflow through the duct.

11. A carburettor as claimed in claim 9, in which each link is adjustable.

12. A carburettor as claimed in claim 9, in which the link includes a cam and follower respectively attached to the vane and the valve.

13. A carburettor as claimed in claim 12 in which the cam has an irregular profile thereby to provide a non-linear relationship between movement of each vane and operation of the valve.

* * * * *